United States Patent [19]

Babbage

[11] 4,351,315

[45] Sep. 28, 1982

[54] BOILERS

[75] Inventor: Thomas A. Babbage, Walton-on-Thames, England

[73] Assignee: Trianco Redfyre Limited, Sheffield, England

[21] Appl. No.: 192,334

[22] Filed: Sep. 29, 1980

[30] Foreign Application Priority Data

Sep. 27, 1979 [GB] United Kingdom ..... 7933548

[51] Int. Cl.[3] ..... F24B 3/04

[52] U.S. Cl. ..... 126/73; 126/125

[58] Field of Search ..... 126/73, 125, 10, 58, 126/74, 77, 67

[56] References Cited

U.S. PATENT DOCUMENTS

| | | | |
|---|---|---|---|
| 274,846 | 3/1883 | Thompson | 126/125 |
| 532,911 | 1/1896 | Knauss | 126/73 |
| 799,311 | 9/1905 | Drake | 126/73 |
| 1,652,268 | 12/1927 | Benjamin | 126/125 |
| 2,481,164 | 9/1949 | Sherman et al. | 126/73 |
| 2,564,713 | 8/1951 | Miles | 126/73 |
| 4,194,487 | 3/1980 | Cadwallander et al. | 126/77 |

*Primary Examiner*—James C. Yeung

*Attorney, Agent, or Firm*—Shoemaker and Mattare, Ltd.

[57] ABSTRACT

A solid fuel boiler has a facia for radiant heat to pass into a living room while the flue hopper, the flueways and ash pan are accessible from another room or out-building. A dividing wall is shown. By separating the radiant and aesthetic side of the boiler which is in the living room from the operating side, dust and dirt often associated with filling and emptying the boiler is confined to the other room or out-building. The flueway is relatively narrow which improves heat-transfer; this is possible because chimney sweeping can be done without having to pass brushes through the flueway.

9 Claims, 1 Drawing Figure

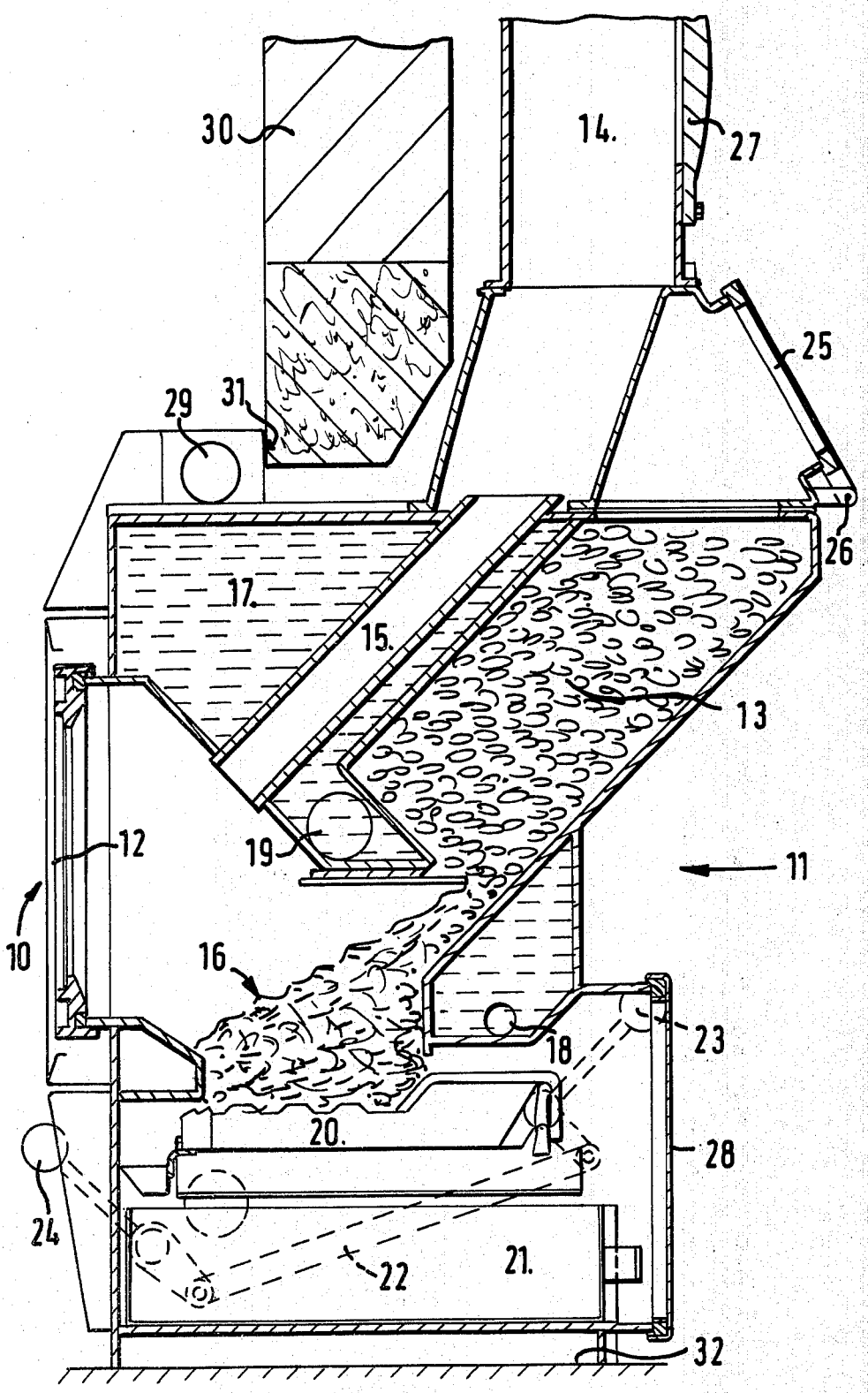
30
14.
27
25
29
31
26
17.
15.
13
12
19
11
10
16
18
23
20.
28
24
22
21.
32

BOILERS

FIELD OF THE INVENTION

The invention relates to solid fuel domestic boilers and roomheaters.

Domestic boilers and roomheaters are appliances which range in output from between about 25,000 and 150,000 BTU and are designed predominantly for use in heating households and supplying heat for domestic hot water and central heating systems. At present very many solid fuel domestic appliances are available, conveniently provided with automatic air control systems and some with gravity feed from a fuel hopper.

SUMMARY OF THE INVENTION

It is an object of the invention to make such appliances more efficient and environmentally more attractive.

According to the invention, there is provided a solid fuel domestic appliance having a front portion and a rear portion, a transparent facia in said front portion, a fuel hopper and a chimney connected at said rear portion, and relatively narrow flue-way means mounted between said front and rear portions.

DESCRIPTION OF THE DRAWING

A solid fuel domestic appliance according to the invention will now be described, by way of example, with reference to the accompanying sectional drawing.

The appliance has a front portion 10 and a rear portion 11. A glass panelled door or facia 12 at the front of the boiler may be hinged or more securely fixed to the appliance housing. A fuel hopper 13 and a flue outlet 14 are mounted at the rear of the boiler. A single or plurality of flue-ways 15, intermediate the front and rear of the appliance extend from above a fire bed 16 towards the flue outlet 14 through a water jacket 17 which has an inlet 18 and outlet 19. A grate arrangement 20 under the fire bed 16 is positioned above an ash pan 21. A de-clinker mechanism 22 having two operating levers 23 and 24 is provided connected to the grate arrangement 20. A door 25 hinged at 26 provides a cover for the hopper 13. A cover plate 27 in the flue outlet 14 enables ready access for cleaning the appliance flue-ways 15 and a chimney to which said flue outlet is connected. A hinged door 28 is provided to allow the ash pan 21 to be removed for emptying. A thermostat 29 mounted on the side of the front facia is arranged to control a flow of air to the fire bed in conventional manner.

The appliance is shown situated in an opening between two rooms which are separated from one another by a wall 30. The appliance is provided with an abutting surface 31, extending upwards from the rear casing, which presses firmly against a surface of the wall 30. The lower part of the appliance is arranged to be a flush fitting with a floor or support surface 32. The joints between the appliance and the wall 30 and the appliance and the surface 32 may be provided with a seal or sealing compound if required to help eliminate or substantially prevent movement past the appliance of air or at least dust particles between the two rooms. The appliance back casing is also provided in similar manner (not shown) with abutting surfaces, and seals if required, extending down each side so that the appliance fits and seals off the aperture in the wall 30 between the two rooms.

Thus, the appliance is situated in a manner to separate environmentally the radiant heating function together with the generally regarded aesthetically attractive aspect of the boiler from the operating and maintenance facilities. It is possible at the front of the appliance to de-ash and change the thermostat setting so as to control the basic running conditions of the appliance. However, refuelling and removal of ash is carried out in a separate room so that dust inherently liberated during such operations is not released into the room occupied by the front of the appliance.

This provision means that the front of the appliance can be sited advantageously in a living room and the rear of the appliance positioned in a utility room, for example. In this way, the environmental objections often regarded as inherent disadvantages of solid fuel appliances are substantially overcome. The dusty operations of filling the fuel hopper and/or emptying the ash are confined to the utility room where creation of dust is generally much less objectionable. At the same time, the natural fire of the appliance can be enjoyed and observd through the door 12 from the living room which room is now substantially free of any dust hazard.

It will be appreciated that the rear of the appliance may be situated within a garage for example, or 'outside' the house. In the latter case, the rear of the appliance is preferably provided with some weather proofing, for example, such as a walled partition extending upwards to, say, just above the cover 25.

The flue-ways 15 of the described boiler are relatively narrow, for example, in a boiler producing 40,000 BTU there is a narrow single flue-way with a cross-sectional area of 10 sq.in. approximately; the flueway provided is 10 inches across and 1 inch wide. In previous arrangements where it was necessary to have access from the front, for cleaning the flue-ways and chimney, in a similar sized boiler there was usually a circular flue-way of approximately 20 sq.in. cross-sectional area. A flue-way having a large cross-sectional area and generally circular shape was previously necessary to allow chimney sweeping to take place because the chimney sweeping brush had to pass through the flue-way. In practice, such flue-ways were usually regarded to be too large for satisfactory heat transfer so baffle plates were provided to retard the flue gas flow through the flue-way. However, to provide reasonable heat transfer efficiency it was necessary to leave only a very narrow opening at the top of the flue-ways for the flue gases to escape past the baffle plate and into the chimney. As a consequence, the narrow opening tended to become blocked and only by frequent cleaning could the appliance heat transfer efficiency be maintained. In the described appliance the flue-ways can be designed not only to enable good heat transfer but overcome the frequent cleaning required. This is because the flue-ways can be relatively narrow, not having to cater for chimney cleaning brushes, so that good scrubbing of the flue gases is achieved and also efficient heat transfer because of the fully water cooled flue-ways.

A further and important advantage is achieved by the described appliance. The flue-ways can be and are normally cleaned by access from the rear. As such flue-ways can be cleaned advantageously without closing down the appliance. The front door or facia is kept closed so that any dust and debris liberated from the flue-ways does not escape out of the front of the appliance. Further, the deposits cleaned off the flue-ways conveniently fall down into the fire bed and can be burned up and their heat content used.

It will be appreciated that in providing a fuel hopper at the rear of the boiler, again especially if this is in a separate room or externally situated relative to a house (in a covered area provided as explained, for example,) has the advantage that a considerably larger hopper can be provided if required to achieve a longer firing duration than before. In previous arrangements, the size of the hopper was restricted by the available space at the front of the appliance and also by appearance of the appliance to the user.

In the appliance described the ash pan is removed via an opening at the rear of the appliance. When the appliance rear is isolated by a wall or the like from the front of the appliance, no dust and ash particles are released into the room where the front of the appliance is situated. In such a situation particularly or in any other situation, the ash pan opening is not restricted directly in size to the general layout and appearance of the front of the appliance. This enables, in general terms, for the opening and ash pan to be somewhat larger is desired than in earlier appliances.

It will be noted that in earlier appliances having a fuel hopper and ash pan removal at the front it was usual to provide the hopper immediately above and the ash pan access immediately below a transparent facia or front cover. In appliances according to the present invention, there is generally less restriction of space so that although the hopper and ash pan are situated at the rear of the appliance, the hopper and ash pan can sometimes advantageously be provided at the rear but to some extent at least extending to the left and/or right of the appliance. In any event access to the fuel hopper and/or ash pan can usually be readily arranged if desired to the left or right of the appliance while not interfering with the sealing abutments at the sides of the appliance.

It will be appreciated that the positioning of the chimney at the rear of the appliance as described means that the appliance can be installed in a building having no conventional chimney or chimney breast. Further, because the chimney can be outside the building for the appliance described, the chimney can be relatively cheap comprising a factory-made insulated chimney extending up to above the roof ridge of the building, for example.

I claim:

1. A solid fuel domestic appliance comprising a framework having a front portion and a rear portion and adapted for fixing in an aperture of a partition wall so that simultaneous access to said front and rear portions is prevented, means defining a combustion chamber in the front portion, a flue outlet for communication with a chimney and a fuel hopper mounted in said rear portion so as to be accessible only from behind said partition wall, means supporting a firebed beneath said fuel hopper at the base of the combustion chamber, a discharge throat of restricted size at the base of said fuel hopper so that fuel flows forwardly and downwardly from said hopper to said firebed to maintain a natural angle of repose therein, a transparent facia mounted in the front portion of the appliance to display the burning firebed, and a relatively narrow flue-way leading from said combustion chamber obliquely rearwards and upwards to said flue outlet, and an access door in the flue outlet to enable the flue-way to be cleaned and the chimney to be swept.

2. An appliance according to claim 1, including a thermostat mounted on said front portion.

3. An appliance according to claim 1, including an ash pan at the bottom of said framework and including means for retracting an ash pan through said rear portion.

4. An appliance according to claim 1, including a manually operable de-ashing mechanism having handle means extending for operation from adjacent both said front and rear portions.

5. An appliance according to claim 1, wherein part of a water jacket is fitted beneath a surface over which the fuel flows from the hopper to the firebed whereby said fuel does not ignite until it reaches said firebed.

6. A building including at least one appliance positioned in an aperture of a wall thereof, said appliance comprising a framework having a front portion and a rear portion and adapted for fixing in an aperture of a partition wall so that simultaneous access to said front and rear portions is prevented, means defining a combustion chamber in the front portion, a flue outlet for communication with a chimney and a fuel hopper mounted in said rear portion so as to be accessible only from behind said partition wall, means supporting a firebed beneath said fuel hopper at the base of the combustion chamber, a discharge throat of restricted size at the base of said fuel hopper so that fuel flows forwardly and downwardly from said hopper to said firebed to maintain a natural angle of repose therein, a transparent facia mounted in the front portion of the appliance to display the burning firebed, and a relatively narrow flue-way leading from said combustion chamber obliquely rearwards and upwards to said flue outlet, and an access door in the flue outlet to enable the flue-way to be cleaned and the chimney to be swept.

7. An appliance according to claim 1, wherein a 40,000 BTU boiler has a flue-way having a cross-sectional area of approximately 10 square inches.

8. An appliance according to claim 1, further including a water cooling jacket surrounding the appliance.

9. An appliance according to claim 1, further including sealing means on the appliance for sealingly engaging a building partition.

* * * * *